US005121851A

United States Patent [19]

Lyon et al.

[11] Patent Number: 5,121,851

[45] Date of Patent: Jun. 16, 1992

[54] RESEALABLE CONTAINER CLOSURE

[75] Inventors: Jay W. Lyon, Greensburg; Scott C. Biondich, Delmont, all of Pa.; James M. Holthaus, Fort Loramie, Ohio; Frank E. Maier, Lower Burrell, Pa.

[73] Assignee: Aluminum Company of America, Pittsburgh, Pa.

[21] Appl. No.: 605,553

[22] Filed: Oct. 29, 1990

[51] Int. Cl.[5] ..... B65D 17/34

[52] U.S. Cl. ..... 220/268; 220/278; 220/258; 220/259

[58] Field of Search ..... 220/266, 267, 268, 270, 220/277, 278, 89.2, 89.3, 254, 258, 259, 265, 269

[56] References Cited

U.S. PATENT DOCUMENTS

| | | | |
|---|---|---|---|
| 3,200,985 | 8/1965 | Ashley | 220/270 |
| 3,246,791 | 4/1966 | Asbury | 220/268 |
| 3,250,426 | 5/1966 | Fraze | 220/231 |
| 3,254,790 | 6/1966 | Dunn | 220/270 |
| 3,281,007 | 10/1966 | Dorosz | 220/270 |
| 3,283,941 | 11/1966 | Rollins et al. | 220/270 X |
| 3,303,958 | 2/1967 | Taylor | 220/270 |
| 3,307,736 | 3/1967 | Kaplow | 220/270 X |
| 3,334,778 | 8/1967 | Saunders | 220/268 X |
| 3,335,899 | 8/1967 | Dunn | 220/270 |
| 3,338,199 | 8/1967 | Taylor | 220/270 X |
| 3,339,790 | 9/1967 | Murdock | 220/270 |
| 3,362,569 | 1/1968 | Geiger | 220/268 |
| 3,416,699 | 12/1968 | Bozck | 220/270 X |
| 3,507,418 | 4/1970 | Saunders | 220/270 |
| 3,779,417 | 12/1973 | Klein | 220/268 |
| 3,929,251 | 12/1975 | Urmston . | |
| 3,977,341 | 8/1976 | Jordan et al. . | |
| 3,997,076 | 12/1976 | Jordan . | |
| 4,024,981 | 5/1977 | Brown . | |
| 4,078,693 | 3/1978 | Asbury | 220/268 |
| 4,148,410 | 4/1979 | Brown . | |
| 4,192,244 | 3/1980 | Kelley et al. | 220/268 X |
| 4,213,538 | 7/1980 | Boardman | 220/268 |
| 4,465,203 | 8/1984 | Lambert | 220/268 |
| 4,580,692 | 4/1986 | La Barge et al. . | |
| 4,648,528 | 5/1987 | La Barge et al. . | |
| 4,685,849 | 8/1987 | La Barge et al. . | |
| 4,783,985 | 11/1988 | La Barge et al. . | |
| 4,928,844 | 5/1990 | La Barge . | |
| 4,932,555 | 6/1990 | La Barge . | |
| 4,957,216 | 9/1990 | La Barge | 220/379 |
| 4,961,511 | 10/1990 | Piltz | 220/270 |
| 4,982,862 | 1/1991 | La Barge | 220/278 |
| 4,991,732 | 2/1991 | La Barge et al. | 215/260 |

FOREIGN PATENT DOCUMENTS

| | | | |
|---|---|---|---|
| 1487478 | 7/1967 | France | 220/267 |

OTHER PUBLICATIONS

W. Coy Willis, Scott C. Biondich, U.S. patent application Ser. No. 397,218 filed Aug. 23, 1989 now abandoned. Titled: Resealable Container Closure.

*Primary Examiner*—Stephen Marcus
*Assistant Examiner*—Stephen Cronin
*Attorney, Agent, or Firm*—William J. O'Rourke, Jr.

[57] ABSTRACT

An improved easy open can end construction for resealable easy open beverage cans having a hinged and inwardly depressible opening panel defined by an involuted spiro-circular score line having an initial portion that at least partially encircles a pressure application zone, an intermediate portion that continually recedes therefrom and an end portion of circular configuration.

15 Claims, 3 Drawing Sheets

RESEALABLE CONTAINER CLOSURE

This invention relates to an improved can end construction for carbonated beverage cans having a selectively shaped, and score line defined, inwardly displaceable opening panel incorporated in a pouring spout assembly adapted to accommodate a resealing cap assembly in overlying relation therewith.

BACKGROUND OF THE INVENTION

Recent years have witnessed ever increasing quantities of carbonated beverages, such as beer and carbonated soft drinks, being typically packaged in amounts of up to twelve (12) ounces in metal cans and particularly in metal cans with ends that include a score line defined opening panel therein to provide implement free access to the contents. Such opening panel containing can ends are generally called "easy open ends" and include several variant basic constructions. Among such variant basic constructions is a first type wherein the score line completely circumscribes the opening panel to render the panel completely separable from the can end as exemplified by U.S. Pat. Nos. 3,254,790 and 3,281,007. Another variant is a second type wherein the score line only partially circumscribes the panel to render the latter only partially severable from the can end and to thus remain in attached relation within the can after the pouring opening has been formed. Included among the variant constructions of the second type are those that include a manually displaceable lever member to fracture the score line and to pivotally displace the hinged opening panel to a location within the can body, as exemplified by U.S. Pat. Nos. 4,024,981 and 4,148,410. Such variant constructions of the second type also include can ends in which the lever member is dispensed with, and score line fracture and inward panel displacement is initiated by application of direct finger pressure on, or adjacent to, a circular score line, as exemplified by U.S. Pat. Nos. 3,929,251, 3,997,076 and 3,977,341. As mentioned above, all such opening panels are conventionally perimetrically delineated by score lines of decreased metal thickness.

A further construction of this second type is employed in non-beverage containers and includes can ends having an arcuate score line configuration that only partially circumscribes the full extent of the can top so as to define a hinge area to retain the partially severed opening panel in an attached and outwardly displaced relation with respect to the can contents, as exemplified by U.S. Pat. No. 3,172,558.

In order to extend the use of easy open can end constructions to larger volume containers, the art has suggested the utilization of a cap assembly to close and reseal the opening defined by a score line defined panel. Among the objects of such cap utilization are a re-closure of the container to prevent loss of liquid content and a resealing of the container to limit further losses of the dissociable gases, i.e., the "carbonation", in the remaining liquid content. U.S. Pat. Nos. 4,580,692 and 4,648,528 disclose suggested constructions for such a resealable closure cap assembly in association with a selectively contoured pouring spout construction to cooperatively accommodate such resealable closure and to retain the advantages characteristic of the "easy open end" constructions. More recently, U.S. patent application Ser. Nos. 338,095, 338,096 and 338,310 have disclosed improved structures for a resealing cap assembly for use with a selectively contoured spout assembly of the general type disclosed in the above noted U.S. Pat. Nos. 4,580,692 and 4,648,528.

Experience to date with the resealable cap and can end construction disclosed in U.S. Pat. Nos. 4,580,692 and 4,648,528, and in the aforesaid patent applications, the disclosure contents of which are herein generally incorporated by reference, has indicated that some difficulties may be encountered by some users in effecting implement free opening of the container. Such difficulties appear to be attributable to effecting optimum location of the point of finger pressure application relative to the score line defined opening panel and in the undue amounts of digital pressure required for effecting score line fracture and panel displacement inwardly of the can particularly when such finger pressure is applied at locations other than the desired optimum location therefor.

SUMMARY OF THE INVENTION

This invention may be briefly described as an improved sheet metal can end construction for resealable easy open cans that includes, in its broad aspects, a hinged inwardly displaceable opening panel defined by a generally involute shaped score line configuration that markedly expands the permitted locus of digitally applied pressure application and conjointly reduces the opening force required to initiate and progressively continue score line fracture and accompanying displacement of the opening panel inwardly of the can. In a further broad aspect, the invention includes an improved spiro-circular score line configuration defining an inwardly displaceable opening panel in a resealable easy open can end construction.

Among the advantages of the subject invention is the provision of an improved construction for resealable easy open can ends requiring markedly decreased opening forces, a markedly enlarged area of optimal location for digital pressure application to initiate and progressively continue score line fracture and a high stability of the container during opening.

The object of this invention is the provision of an improved construction for score line defined opening panels in resealable easy open can ends.

A further object of this invention is the provision of a generally involuted, spiro-circular shaped score line configuration for defining an inwardly displaceable opening panel in a resealable easy open can top.

A further object of this invention is the provision of an improved construction for resealable easy open can ends and particularly for the resealable easy open can end constructions broadly disclosed in U.S. Pat. Nos. 4,580,692 and 4,648,528.

Other objects and advantages of the invention will become apparent from the following portions of this specification and from the appended drawings which illustrate, in accord with the mandate of the patent statutes, presently preferred embodiments of a can end construction that incorporates the principles of this invention.

DETAILED DESCRIPTION OF THE INVENTION

As noted above, the present invention is described in association with a resealable easy open end construction of the type generally disclosed in U.S. Pat. Nos. 4,580,692 and 4,648,528 and in the aforesaid patent applications, the disclosure contents of which are incorporated by reference. However, it should be understood that the invention may be used in other easy open end can constructions.

Where the words "upwardly", "inward", "outwardly", "under", "underside", "downwardly" and the like are used herein, the meaning, unless specifically indicated to the contrary, is to be applied with reference to a metal can standing on its base in an upright position having a sheet metal can end incorporating this invention attached to the top end thereof.

Figure 1:
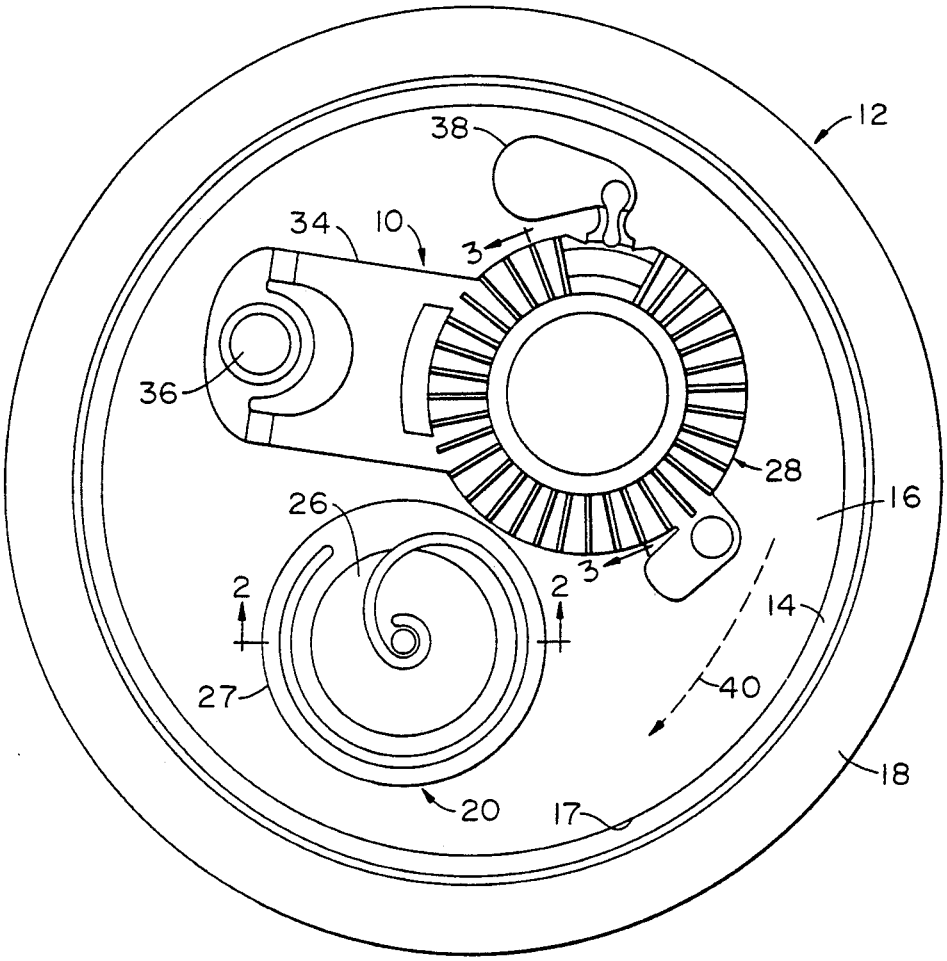
FIG. 1 is a plan view of an opening panel construction incorporating the principles of this invention as included in a resealable open end can end construction of the type generally disclosed in U.S. Pat. Nos. 4,580,692 and 4,648,528.
Figure 2:
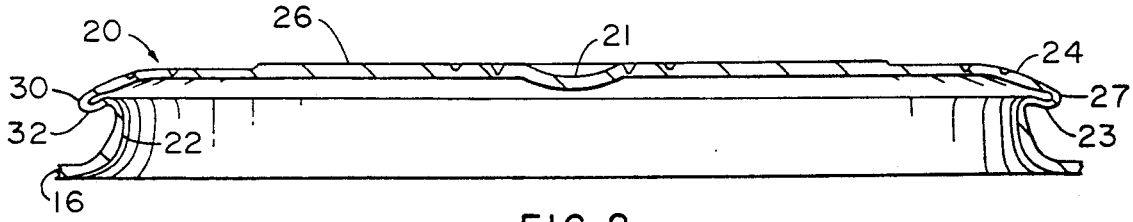
FIG. 2 is an enlarged sectional view of the pouring spout assembly as taken on the line 2—2 of FIG. 1.
Figure 3:
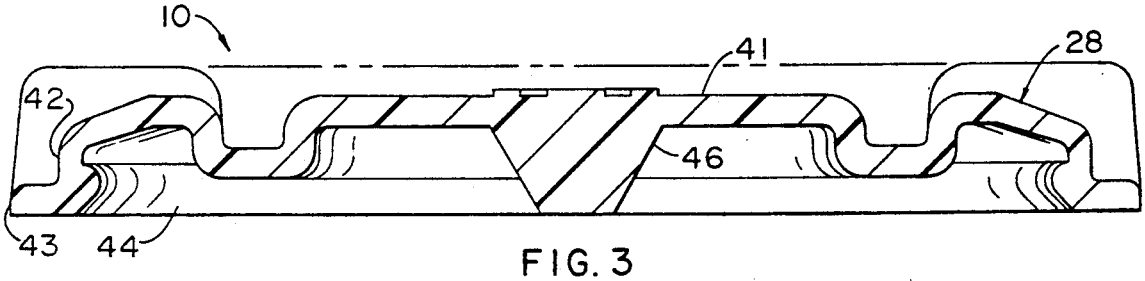
FIG. 3 is an enlarged sectional view of a resealable cap assembly as taken on the line 3—3 of FIG. 1.

Referring to the drawings, and initially to FIGS. 1 to 3, there is depicted a resealable easy open can end structure formed of sheet metal and of the general type disclosed in the aforesaid U.S. Pat. Nos. 4,580,692 and 4,648,528. More specifically, there is disclosed an easy open can end closure 12 prior to the can end closure's engagement with a can body such as by conventional double seaming. Such can end closure 12 includes a generally flat or planar end wall portion 16, a countersink defining inner sidewall 17 and an outer sidewall 14 terminating in an upwardly and outwardly projecting annular flange 18 forming a chime for conventional attachment of the can end to a can body by double seaming.

As best shown in FIGS. 1 and 2, the can end closure 12 includes an upwardly projecting dispensing spout assembly, generally designated 20, suitably of circular configuration and formed as an integral portion of the can end closure. Such spout assembly 20 includes an upwardly projecting sidewall 22, an outwardly extending intermediate wall portion 23, an inclined peripheral wall portion 24, and a flat or slightly upwardly domed top wall portion 26. The top wall portion 26 may include a slightly raised central portion as illustrated in FIG. 2. The intermediate wall portion 23 and the inclined peripheral wall portion 24 cooperatively form a continuous lip 27 having substantially smooth sealing surfaces 30 and 32.

Associated with the dispensing spout assembly 20 is a resealing cap assembly, generally designated 10, preferably molded in one piece of a resinous or plastic material having a low modulus of elasticity, such as, for example, low density polyethylene. As best shown in FIGS. 1 and 3, the resealing cap assembly 10 includes a sealing cap portion, generally designated 28, adapted to be placed in sealing relation over the spout assembly 20, an extending arm portion 34, and a tab 38 projecting outwardly from the sealing cap portion 28 for convenience in manipulation of the cap. The cap assembly 10 is preferably pivotally attached to the end wall 16 by means of a rivet 36 extending through an appropriate opening at the remote end of the arm 34. The outboard edge of the flange of the rivet 36 is forced downwardly a controlled amount when the rivet is staked, not only to securely attach the cap assembly 10 to the can end 12, but also to permit the sealing cap portion 28 to be rotated by hand about the rivet 36 with relative ease in a path of travel generally indicated by the dotted line 40. Preferably, the rivet 36 is an integrally formed portion of the end wall 16.

Referring now particularly to the enlarged showing of FIG. 3, the sealing cap 28 includes a top wall portion 41 and a depending perimetric skirt 42. An annular lip 43 projects outwardly from the distal end of the skirt 42. An annular wedge shaped ledge 44 projects inwardly from the skirt 42 near the distal end thereof to peripherally engage the spout lip 27. The skirt 42 has an inside diameter slightly less than the outside diameter of the spout lip to provide an interference fit therebetween.

After dispensing a portion of the can contents, resealing of the can may be readily accomplished by positioning the seal cap 28 in a concentric overlaying position over the spout assembly 20 and applying a downward pressure substantially uniformly across the periphery of the seal cap to effect engagement with the spout assembly 20. Engagement may be made with least required force by applying downward pressure at a point or relatively small area adjacent to the edge of the seal cap 28 so as to concentrate the force necessary to spring only a relatively small segment of the skirt 42 outwardly and downwardly a distance sufficient for the ledge 44 to clear the spout lip 27. Assuming one's thumb is used to apply the force, the thumb is then rolled, turned or otherwise moved such that the force is applied progressively around the circumference of the cap 28 until engagement is completed.

To disengage the sealing portion of the cap 28 from the spout assembly 20, tab 38 is grasped and lifted. Such lifting causes the ledge 44 to slide outwardly relative to surface 32 of the spout lip 27 adjacent to the line of connection between the tab 38 and the seal cap 28, thereby disengaging ledge 44 from lip 27 at that point. As the lifting of the tab 38 is continued the ledge 44 is progressively disengaged around the perimeter of he spout lip 27.

Figure 4:
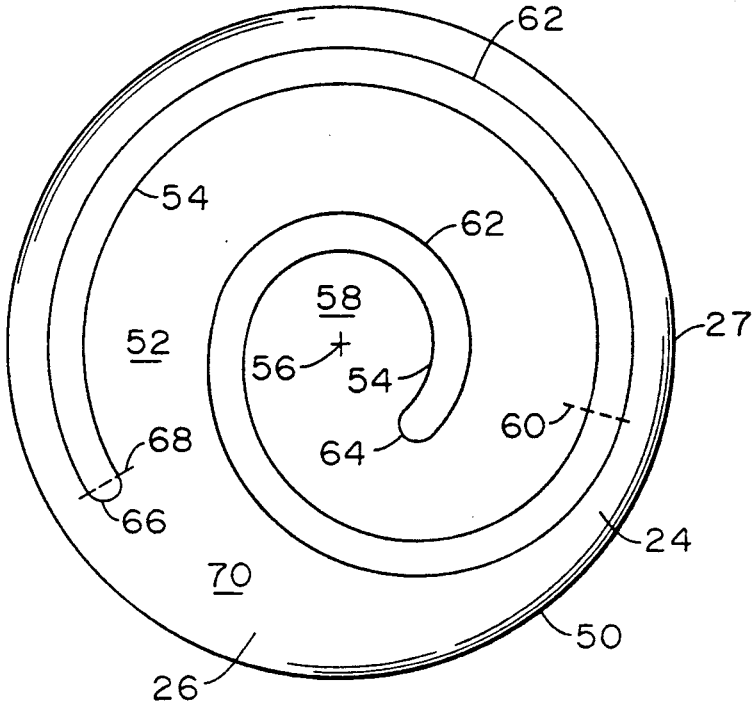
FIG. 4 is an enlarged schematic plan view of a pouring spout construction including a score line defined opening panel for resealable easy open can ends that incorporates the principles of this invention.

FIG. 4 is a schematic plan view of an improved score line defined opening panel for incorporation into the pouring spout assembly 20 as illustratively depicted in FIGS. 1 and 2 and described above. As here shown, the outer periphery of the top wall portion 26 is defined by the marginal edge of the spout lip 27 outwardly of the inclined wall portion 24. Included within the top wall portion 26 is an opening panel, generally designated 52, defined by a first counterclockwise, generally involute shaped score line 54. More specifically, the generally involute shaped score line 54 is of composite spiro-circular configuration, the initial and generally circular portion of which is spaced from and at least partially encircles the center 56 of the top wall 26 to delineate a pressure application zone 58 thereon, and thereafter continually recedes from such center 56 until it nears the marginal edge 50, as at location 60, after which it continues in a circular path 54 in uniform spaced relation with said edge 50. Disposed in outwardly and substantially uniformly spaced relation with the first score line 54 is a second and complementally shaped, angularly coextensive anti-fracture score line 62. The inner ends of the score lines 54 and 62 may be connected by an arcuate fracture limiting score line 64 and the outer ends thereof may be connected by a similar fracture limiting segmental score line 66. As shown in the drawing, the composite spiro-circular score lines 54 and 62 outwardly terminate at a location 68 disposed in arcuate spaced relation with the location 60. A portion 70 of the top wall 26 disposed between the score line terminus 68 and an intermediate portion of the score line serves as a hinge to prevent separation of the opening panel 52 from the remainder thereof. Such hinge typically extends from a tangent point of the terminus 68 across the unscored portion 70 of the top wall 26 to a tangent point near location 60 on the score. The hinge is typically characterized by a relatively large radius of curvature. It is also noted that the structure of the spiro-circular score and relatively large hinge area assures that the opening panel 52 will remain attached to the remainder of the spout as the anti-fracture score structure will absorb energy under blow-off or sudden decompression situations.

In the embodiment depicted in FIG. 4 the spiro-circular score line 54 extends through an arc about 615 degrees.

In the utilization of the above described construction for a generally involuted spiro-circular score line defined opening panel 52, selective fracture of the score line 54 is initiated at or near its inner end by a downward pressure on the center zone 58. Continued downward pressure application at the zone 58 will result in a continued and progressively advancing selective fracture of the score line 54 toward the outer end thereof and in separation and depression of the opening panel 52 pivotally about the unsevered hinge area 70 downwardly into the can body. As will be now apparent, such downward pressure can be digitally applied; however, such pressure application is preferably applied through a complementally shaped and downwardly extending leg 46 or the like on the underside of the sealing cap 32. as shown in FIG. 3.

In a preferred embodiment, the configuration of the leg 46 mates with the configuration of a depression 21 centrally located within the spiro-circular score. In a preferred embodiment the center of the spiro-circular score is also the center of the opening panel 26. The leg 46 and mating depression cooperate when digital pressure is applied centrally of the cap to concentrate opening pressure to a small area in the center zone 58. Also, the score line 54 is preferably provided to a greater depth (i.e., lower metal residual) toward the inner end and is preferably provided at less depth (i.e., higher metal residual) toward the outer end. For example, for an opening panel having a gauge of about 0.012 inch, a metal residual of about 0.0007–0.0020 inch may be provided, while at the outer end a metal residual of about 0.0020–0.0045 inch may be provided. Such metal residual differential, as well as the concentration of force accomplished through the complementary structure of the leg 46 of the cap 10 and the depression 21 of the central zone 58 of the panel 26 cause the inner terminal end portion of the score to be the location where fracture is initiated. The preferred structure of the spiral score is such that downwardly directed digital forces are concentrated at the central zone 58 of the panel 26. Such concentration of forces allows internal can pressure to be overcome relatively easily. Initiation of fracture at such inner location on the score line causes the gaseous contents of the container to vent and thereby decompress. After venting and decompression, the continued depression of the leg 46 toward the central panel 58 of the panel 26 causes the fracture of the score line to propagate along the spiro-circular path, and once fracture has been initiated, propagation even along progressively increasing metal residuals is readily and easily accomplished. It should be noted that it is the combination of the small area enclosed by the inside portion of the score and the change in metal residual along the score which permits opening of the spout without mechanical means yet withstands internal pressures necessary to satisfy the specifications for can end buckle resistance.

It will be appreciated by those skilled in the art that a low metal residual toward the inner end of the score is preferred to permit fracture to be initiated upon the application of concentrated digital pressure. Also, a higher metal residual toward the outer portions of the score is preferred to retain spout integrity and resist fracture before the can is desired to be opened. Thus, the pour spout is able to withstand internal pressures such as those which result from storage of the contents even at elevated temperatures or through rough handling environments.

The depression 21 is preferred in the central region 58 for a number of reasons. For example, the depression would move the area of concentrated force inwardly of the general plane of the opening panel 26. Therefore, if the panel comes into contact with a generally flat surface, the area of concentrated force is protected from such contact. By such construction, the inner ends of the score line 54 where the metal residual is preferably the lowest is likewise protected from initiation of fracture by such flat surface contact. Although such depression 21 is preferred, such as for this reason, it will be appreciated that various structures such as a raised boss as discussed below, or an outwardly projecting bubble, may be employed to cooperate with a leg on the cap to concentrate digital force to initiate fracture of the inner end of the score line 54.

Figure 5:
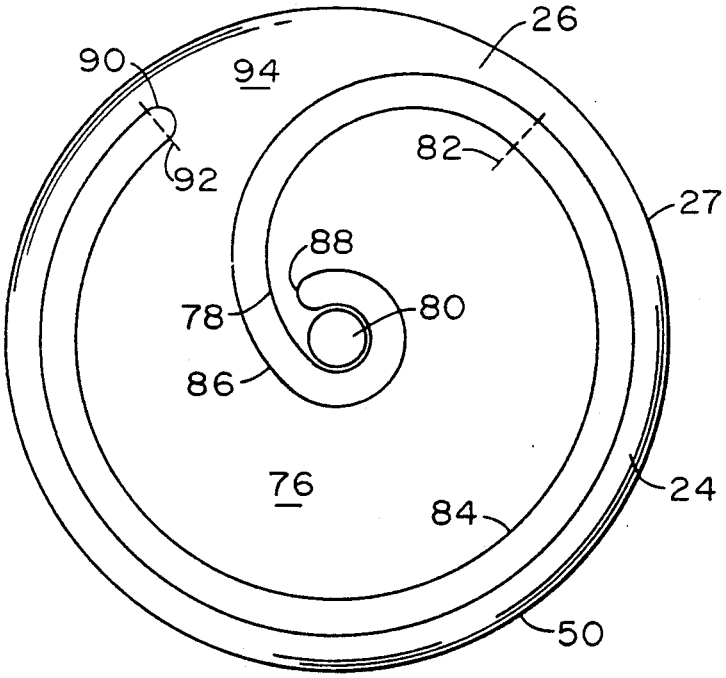
FIG. 5 is an enlarged schematic plan view of a pouring spout construction that includes an alternative score line defined opening panel for resealable easy open can ends that incorporates the principles of this invention.

FIG. 5 depicts an alternative generally involuted, spiro-circular score line configuration for an opening panel in a pouring spout assembly on a resealable easy open can end construction that incorporates the principles of this invention. Here provided is a score line configuration essentially similar to that described above in conjunction with FIG. 4 except that the spiro-circular score line here progresses in the clockwise direction rather than counterclockwise. Included within the top wall portion 26 is an opening panel, generally designated 76, defined by a first clockwise spiro-circular score line 78, the inner portion of which is basically of circular shape spaced from and at least partially surrounding a raised boss 80 delineating a pressure application zone. It will be appreciated that a depression such as depression 21 in FIG. 2 may be utilized as an alternative to a raised boss 80 to focus digital opening pressure in such central location. The intermediate portion of the score line 78 continually recedes from said boss 80 until it approaches the marginal edge 50, as at location 82, after which it continues in a circular path 84 in uniform spaced relation with the edge 50. Disposed in outwardly and substantially uniformly spaced relation with the first score line 78 is a second and anti-fracture score line 86. The inner and outer ends of the score lines 78 and 86 are preferably connected by arcuate segmental fracture limiting score lines 88 and 90, respectively. The score lines 78 and 86 extend through an arc of about 600 degrees. As shown in FIG. 5, the spiro-circular score lines 78 and 86 outwardly terminate at a location 92 disposed in arcuate spaced relation with the location 82. A portion of the top wall 26 of the spout assembly disposed between the location 92 and the score lines 78 and 86, generally designated as 94, serves as a hinge to prevent separation of the opening panel 76 from the remainder thereof.

Operation of the FIG. 5 construction in response to downward pressure applied to the boss 80 is essentially the same as that described above for FIG. 4, except for the clockwise direction of score line 78 fracture progression.

Figure 6:
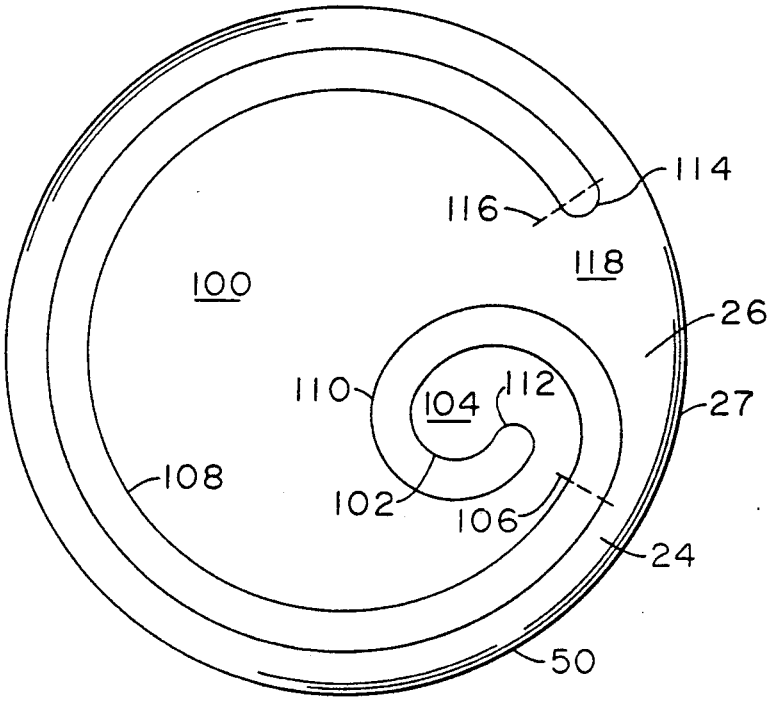
FIG. 6 is an enlarged schematic plan view of a pouring spout construction that includes another alternative score line defined opening panel for resealable easy open can ends.

FIG. 6 is illustrative of another, alternative generally involuted spiro-circular configuration for a score line defined opening panel in a pouring spout assembly in a resealable easy open can end construction. There is here provided an opening panel 100 defined by a first clockwise and relatively tight spiro-circular score line 102, the initial portion of which is offset from the center of the top wall 26 and disposed in relatively close proximity to the marginal edge 50 thereof. Here again the initial portion of a first score line 102 winds around and at least partially encircles a pressure application zone 104 and thereafter continuously recedes from such zone while approaching the marginal edge 50, as at location 106, after which it continues in a circular path 108 in uniform spaced relation with such edge 50. Disposed in outwardly and substantially uniformly spaced relation with the first score line 102 is a second and anti-fracture score line 110. The inner and outer ends of the score lines 102 and 110 are connected by fracture limiting segmental score lines 112 and 114, respectively. As shown, the spiro-circular score lines 102 and 110 outwardly terminate at a location 116 disposed in arcuate spaced relation with the spiro-circular transition location 106. The portion of the top wall 26 disposed therebetween, and generally designated as 118, serves as a hinge to prevent separation of the opening panel 100 from the remainder thereof.

In the utilization of this FIG. 6 configuration selective fracture of the score line 102 at its inner end is effected by downward pressure on the zone 104 which, as will now be apparent, may be positioned relatively close to the longitudinal center line of the can body for enhanced stability during opening. Continued downward pressure applied to the zone 102 results in a continued and progressively advancing selective fracture of the score line 104 towards the outer end thereof and in separation and downward depression of the opening panel 100 pivotally about the unsevered hinge area 118. Such downward pressure may be applied digitally or, preferably, through a complementally shaped dependent boss or leg on the underside of the sealing cap 32.

Center zone 104 shown in FIG. 6, defined inside the spiro-circular score line 102, is within a tighter radius of curvature than that shown in FIG. 5. As described above, fracture of the score at the inner end of the score is initiated to decompress the container. The initial fracture thus functions as a vent. It has been found that the tighter the radius of curvature of the inner portions of the score defining the center zone, the more likely that the metal within such zone will yield permanently upon venting and the less likely that the metal within such zone will experience spring back to reclose the vent. In most instances, the permanent yield to assure that the vent remains opened is preferred.

Figure 7:
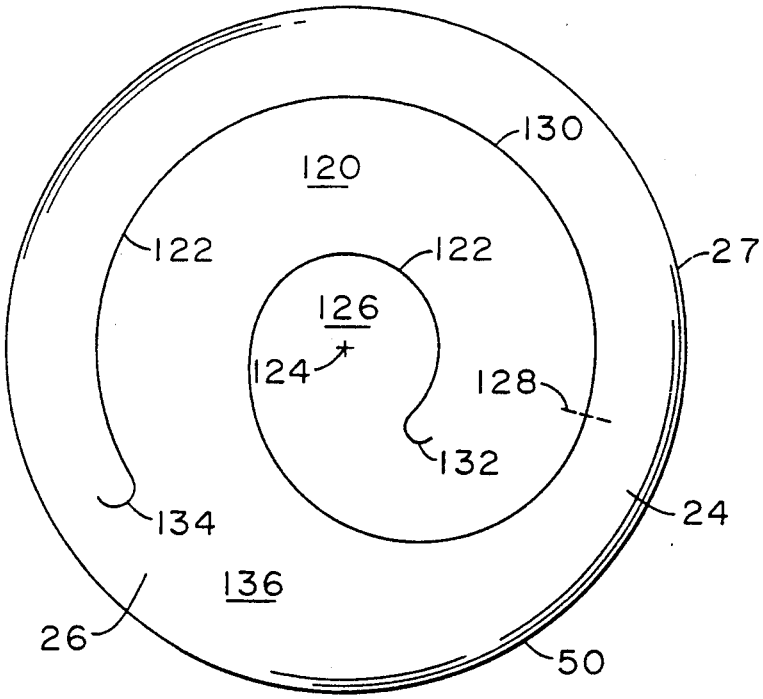
FIG. 7 is an enlarged schematic plan view of a pouring spout construction that includes an alternative score line defined opening panel for resealable easy open can ends.

FIG. 7 depicts a further involuted spiro-circular configuration for a score line defined opening panel in a pouring spout assembly in a resealable easy open can end construction. Included on the top wall 26 of the pouring spout assembly 20 is an opening panel, generally designated 120, defined by a spiro-circular score line 122. The initial portion of the score line 122 is spaced from and circles around the center 124 of the top wall 26 to delineate a pressure application zone 126 and thereafter continually recedes from such center 124 until it nears the marginal edge 50, as at location 128, after which it continues in a circular path 130 in uniform spaced relation with such edge. This embodiment does not employ an anti-fracture score line. The inner and outer ends of the score line 122 are terminated by outwardly directed small diameter fracture limiting arcuate segments 132 and 134, respectively. The outer termination 134 of the score line 122 is disposed in arcuate spaced relation with the location 128 with the portion 136 of the top wall 26 disposed therebetween serving as a hinge to prevent separation of the opening panel 120 from the remainder of the can end.

Selective initial fracture of the inner end portion of the score line 122 is effected by application of downward pressure upon the zone 126. Continued pressure application results in a continued and progressively advancing score line fracture toward the outer end thereof. Such progressively advancing fracture of the score line 122 is effectively halted by the arcuate terminal segment 134. The downward pressure that induces progressive fracture effects separation and downward depression of the opening panel 120 pivotally about the unsevered hinge portion 136 into the underlying can body. As previously noted, such downwardly applied pressure can be digitally applied directly to the top wall 26 preferably through the agency of a selectively shaped dependent boss or leg on the underside of the sealing cap 32.

Having thus described our invention, we claim:

1. In a sheet metal easy open can end closure for beverage containers having a pouring spout releasably engageable by a displaceable sealing cap and wherein said pouring spout includes a top wall portion having an inwardly displaceable opening panel therein, the improvement comprising a generally involute shaped pressure fracturable score line defining said opening panel, said score line having an initial portion that at least partially encircles a pressure application zone, an intermediate portion continually receding therefrom and an end portion of arcuate configuration disposed adjacent to the periphery of said pouring spout, and wherein said end portion of arcuate configuration is disposed in spaced relation with said intermediate portion of said score line to define an inseparable hinge portion therebetween.

2. A sheet metal easy open can end closure as set forth in claim 1 wherein said score line is of composite spiro-circular configuration.

3. A sheet metal easy open can end closure as set forth in claim 1 further including an anti-fracture second score line disposed in adjacent spaced relation with said first mentioned score line.

4. A sheet metal easy open can end closure as set forth in claim 3 wherein said first and second score lines are angularly coextensive and are interconnected at their inner and outer terminal ends by fracture limiting arcuate segments.

5. A sheet metal easy open can end closure as set forth in claim 1 wherein said pressure application zone is disposed substantially at the center of said top wall portion of said pouring spout.

6. A sheet metal easy open can end closure as set forth in claim 1 wherein said pressure application zone is disposed adjacent to a marginal defining edge of said top wall portion of said pouring spout.

7. A sheet metal easy open can end closure as set forth in claim 1 wherein the score line has a greater metal residual at an outer portion as compared to an inner portion.

8. In a sheet metal easy open can end closure for beverage containers having a pouring spout assembly releasably engageable by a displaceable sealing cap and wherein said pouring spout assembly includes a generally circular top wall portion, an inwardly displaceable opening panel provided in said top wall portion of said pouring spout assembly, the improvement comprising a generally involuted spiro-circular shaped and progressively pressure fracturable score line defining said opening panel having an initial portion that at least partially encircles a pressure application zone, an intermediate portion continually receding therefrom and an end portion of arcuate configuration disposed adjacent to the periphery of said pouring spout assembly, said arcuate configuration end portion of said score line having a terminal end disposed in spaced relation with said intermediate portion defining an inseparable hinge area therebetween, and a complementally shaped spiro-circular anti-fracture second score line disposed in adjacent uniform spaced relation with said first mentioned score line.

9. A sheet metal easy open can end closure as set forth in claim 8 wherein said first and second score lines are angularly coextensive and are interconnected at their inner and outer terminal ends by fracture limiting arcuate segments.

10. A sheet metal easy open can end closure as set forth in claim 8 wherein said pressure application zone is disposed substantially at the center of said top wall portion of said pouring spout assembly.

11. A sheet metal easy open can end closure as set forth in claim 8 wherein said pressure application zone is disposed adjacent to a marginal defining edge of said top wall portion of said pouring spout assembly.

12. A sheet metal easy open can end closure as set forth in claim 8 wherein the score line has a greater metal residual at an outer portion as compared to an inner portion.

13. A sheet metal easy open can end closure for beverage containers comprising a pour spout assembly releasably engageable by a displaceable sealing cap, having a generally circular top wall portion and a peripheral lip portion with smooth sealing surfaces thereon, an inwardly displaceable opening panel in the top wall portion of the pour spout assembly defined by a generally involuted spiro-circular shaped and progressively pressure fracturable score line, having an initial portion that at least partially encircles a pressure application zone having a depression therein extending below the general plane of the top wall portion, an intermediate portion continually receding therefrom, and an end portion of circular configuration disposed adjacent the periphery of the top wall portion of said pouring spout assembly, said circular configuration end portion of said score line having a terminal end disposed in spaced relation with said intermediate portion defining a hinge area therebetween, said sealing cap adapted to reseal the pour spout by frictional engagement over the sealing surfaces of the lip portion, and said sealing cap having a central portion overlying the pressure application zone when the sealing cap is centered over the pour spout assembly, said central portion having an inwardly extending boss facing the depression in the pressure application zone whereby digital pressure against the outside surface of the sealing cap centered over the pour spout is capable of being transferred through said inwardly extending boss to the depression in the pressure application zone to concentrate such force and initiate fracture of the spiro-circular score at the initial portion thereof.

14. A sheet metal easy open can end closure as set forth in claim 13 having a complementally shaped spiro-circular anti-fracture second score line disposed in adjacent uniform spaced relation with said first mentioned score line.

15. A sheet metal easy open can end closure as set forth in claim 13 wherein the score line has a greater metal residual at an outer portion as compared to an inner portion.

* * * * *